United States Patent [19]

Summers

[11] Patent Number: 4,718,971

[45] Date of Patent: Jan. 12, 1988

[54] DISPENSER FOR A TRANSFER ADHESIVE

[75] Inventor: Frank P. Summers, Medford, N.J.

[73] Assignee: Moore Push-Pin Company, Wyndmoor, Pa.

[21] Appl. No.: 917,010

[22] Filed: Oct. 9, 1986

[51] Int. Cl.[4] ..... B32B 35/00

[52] U.S. Cl. ..... 156/540; 156/577; 156/578; 156/579; 156/584; 225/51

[58] Field of Search ..... 156/540, 541, 577, 579, 156/523, 527, 584, 574, 578; 221/73; 225/51

[56] References Cited

U.S. PATENT DOCUMENTS

| | | | |
|---|---|---|---|
| Re. 25,056 | 10/1961 | Fritzinger | 156/523 |
| D. 175,505 | 9/1955 | Larsen | D74/1 |
| D. 178,713 | 9/1956 | Williams | D74/1 |
| D. 180,488 | 6/1957 | Larson | D74/1 |
| D. 180,527 | 6/1957 | Polster | D74/1 |
| D. 280,738 | 9/1985 | Grassi | D19/68 |
| 3,274,038 | 9/1966 | Karn | 156/247 |
| 3,308,002 | 3/1967 | Hurwich et al. | 156/577 |
| 3,339,797 | 9/1967 | Knutson | 221/73 |
| 3,399,100 | 8/1968 | Rothenberger | 156/523 |
| 3,509,000 | 4/1970 | Brown | 156/584 |
| 3,740,299 | 6/1973 | Schroter | 156/577 |
| 3,839,127 | 10/1974 | Hazuka | 156/540 |
| 3,902,956 | 9/1975 | Thompson | 156/523 |
| 3,969,181 | 7/1976 | Seabold | 156/577 |
| 4,151,039 | 4/1979 | Lash | 156/584 |
| 4,328,061 | 5/1982 | Off et al. | 156/578 |
| 4,336,097 | 6/1982 | Van Kampen et al. | 156/527 |

OTHER PUBLICATIONS

Moore Push-Pin Co. brochure—"Tacky Tape" (10/1985).

*Primary Examiner*—Michael Wityshyn
*Attorney, Agent, or Firm*—William H. Eilberg

[57] ABSTRACT

The invention is an improved dispenser for a transfer adhesive. The adhesive is called a "transfer" adhesive because it is separated from its backing material and transferred onto a working surface, without the backing. The adhesive and backing are initially formed on a tape which is threaded from a supply reel, and around a tape roller, the spent backing being wound on a take-up reel. The adhesive is applied by rolling the tape roller along the working surface. In the present invention, the tape roller is attached to a lever, which can assume two positions. In the first position, the lever prevents the supply reel from rotating. In the second position, the lever allows the supply reel to rotate. The lever is spring-biased so that it is normally in the first position. When the tape roller is pressed against the working surface, so as to apply the adhesive, the lever shifts to the second position. Thus, the dispenser is automatically enabled when one begins to use it, and is automatically disabled when the dispenser is put aside. The dispenser is designed to facilitate the removal of spent tape backing from the device. The dispenser also includes structure which insures that the tape will always remain taut.

25 Claims, 7 Drawing Figures

DISPENSER FOR A TRANSFER ADHESIVE

BACKGROUND OF THE INVENTION

The present invention relates to the field of dispensers for transfer adhesives. As used herein, the term "transfer adhesive" refers to an adhesive which is originally disposed on a backing, or liner, and which is separated from the backing and applied to a surface.

Transfer adhesives have many uses. For example, they can be used to attach papers to a bulletin board, or similar surface. When a web of transfer adhesive has been applied to the surface, a paper pressed onto the adhesive will adhere to that surface. If the proper transfer adhesive composition is chosen, the paper can be easily removed from the surface without tearing.

One example of a dispenser for a transfer adhesive is shown in U.S. Pat. No. 3,969,181. In the device shown in the latter patent, a tape, which includes the transfer adhesive and a backing, is fed from a supply reel and around a tape roller. The backing, after being separated from the adhesive, is wound around a take-up reel. The reels are normally prevented from moving by a detent engaging a serration on a gear. The reels are allowed to move only when a trigger, releasing the detent, is depressed.

The prior art contains numerous other examples of devices for dispensing tapes having adhesives and liners. One such device is shown in U.S. Pat. No. 3,839,127, which shows a deflecting member for diverting the waste liner from the adhesive, after the adhesive and the liner are separated. Other devices involving tapes and liners are shown in U.S. Pat. Nos. 3,509,000 and 4,336,097.

It is important that a tape dispenser not dispense any tape when the device is not in use. In U.S. Pat. No. 3,969,181, described above, the trigger mechanism prevents the dispenser reels from rotating except when the trigger is depressed. In other devices the trigger may assume a different form, or it may appear on a different part of the dispenser.

Trigger-operated dispensers, of the type described above, are inconvenient or confusing, for many users. To operate such a dispenser, the user must perform several operations in a particular order. First the user must apply the device to the working surface. Then, the user must depress the trigger. Then, the device must be moved along the surface, to apply the adhesive, while the trigger is held in the operating position. Finally, the trigger is released and the device laid aside. If the steps described above are not performed in the correct order, the dispenser will not operate.

The present invention makes it easier to use a dispenser for a transfer adhesive, by providing an improved device which is actuated automatically when it is used. That is, the very act of pressing the dispenser against the working surface enables the supply and take-up reels to rotate. The dispenser returns automatically to the disabled position when the device is laid aside.

The device also has other advantages. It includes means for assuring that the tape will be maintained in a taut position. And it is designed to facilitate the removal of spent backing from the device, without dismantling the take-up reel.

SUMMARY OF THE INVENTION

The tape dispenser of the present invention has a supply reel, a take-up reel, and a tape roller. The supply and take-up reels are connected by gears, so that rotation of one reel causes rotation of the other. The gearing relationship is preferably such that the speed of the take-up reel is 1.5 times faster than that of the supply reel. A tape, containing a transfer adhesive and a backing or liner, is threaded from the supply reel, around the tape roller, and onto the take-up reel.

The tape roller is connected to one end of a lever, the other end of the lever terminating in a detent, or equivalent means, which engages a toothed wheel attached to the supply reel. The lever is spring-biased so that the detent normally engages the toothed wheel, and prevents the supply reel from rotating. Thus, the dispenser is disabled when not in use. In one embodiment, the means of biasing the lever includes a spring bar which can be integrally formed with the lever, and which is generally parallel to the lever. In another embodiment, the lever is biased by a separate rod which fits freely into a hole in the lever assembly, and which is generally perpendicular to the lever.

When the user presses the dispenser, and hence the tape roller, against the working surface, the lever moves to the position wherein the detent is released from the toothed wheel on the supply reel. Thus, the act of placing the dispenser on the surface, and applying a small amount of pressure, causes the lever to pivot around its fulcrum, so that the detent disengages from the supply reel, and allows the reels to rotate. Moving the dispenser along the surface causes the tape to move, due to friction with the surface. The motion of the tape causes the supply reel to rotate, and the gearing between the supply and take-up reels insures that the take-up reel will also rotate. Thus, the backing will be wound onto the take-up reel, after the adhesive material has been transferred onto the surface. When the pressure on the dispenser is released, the detent returns to its original position, again preventing the supply and take-up reels from rotating.

The take-up reel is mounted for rotation around a bearing surface, which, in the preferred embodiment, is integrally-formed with the gear which drives the take-up reel. The spent backing material is wound around the take-up reel, and there are no clamps, or other structures, holding the spent backing onto the reel. When it becomes necessary to discard the spent backing material, one simply opens the lid of the dispenser and lifts the spent backing out of the take-up reel.

Because the take-up reel can rotate about its bearing surface, the take-up reel can be driven at a faster rate than the supply reel. In this way, the tape will always remain taut.

It is therefore an object of the invention to provide a dispenser for applying a transfer adhesive to a surface.

It is another object of the invention to provide a dispenser for a transfer adhesive, wherein the dispenser is automatically enabled by use, and automatically disabled when the device is not in use.

It is another object to provide a dispenser as described above, wherein the dispenser is enabled by a small amount of pressure applied towards the working surface.

It is another object to facilitate the application of a transfer adhesive onto a working surface.

It is another object to provide a dispenser as described above, wherein the reels in the dispenser cannot rotate, except when the device is in use.

It is another object to provide a dispenser as described above, wherein the used tape backing can be easily removed from the device.

It is another object to provide a dispenser as described above, wherein the tape backing remains taut as it passes through the device.

Other objects and advantages of the invention will be apparent to those skilled in the art, from a reading of the following brief description of the drawings, the detailed description of the invention, and the appended claims.

DETAILED DESCRIPTION OF THE INVENTION

Figure 1:
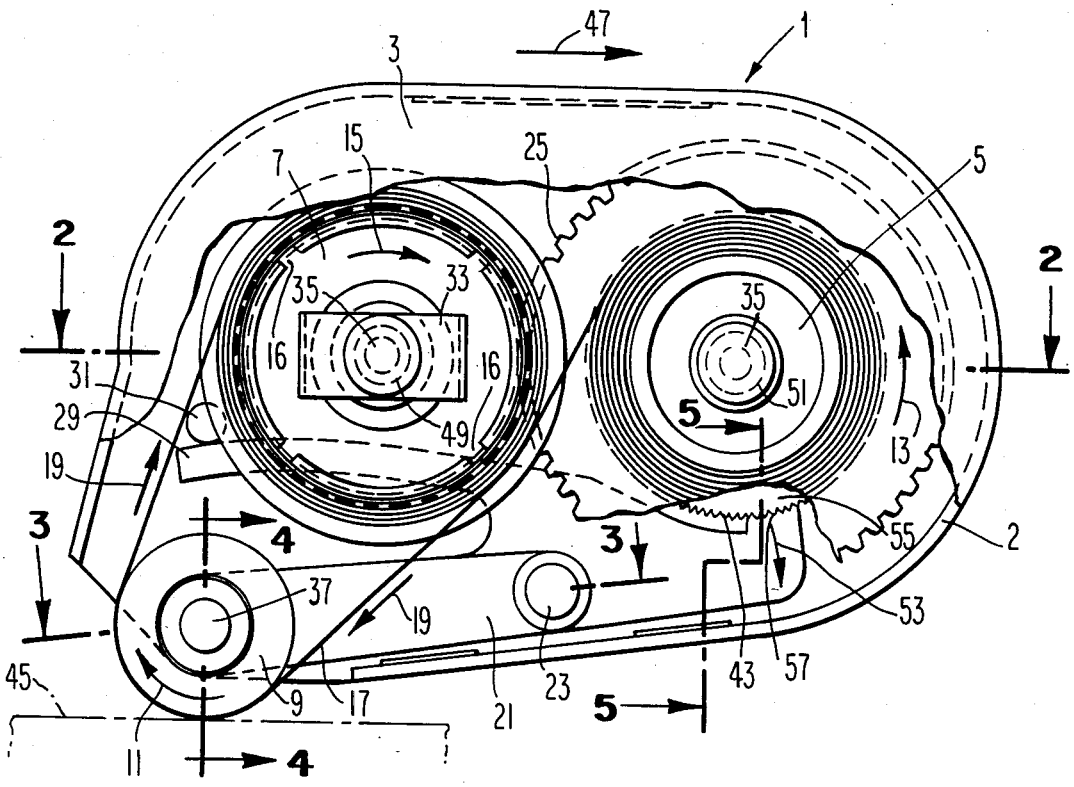
FIG. 1 is a top plan view, partly broken away, showing the tape dispenser made according to one embodiment of the present invention.

The dispenser of one embodiment of the present invention is shown in a top plan view in FIG. 1, which is partly broken away to show the interior of the device. Dispenser 1 comprises housing 2, which includes lid 3. The lid can be removed from the housing to provide access to the interior of the dispenser. The dispenser includes supply reel 5, take-up reel 7, and tape roller 9. As is shown more clearly in FIG. 2, supply reel 5 is integrally-formed with gear 25, and the supply reel is disposed for rotation around bearing surface 51, which is integral with housing 2. Take-up reel 7 rotates around bearing surface 49, but, in the preferred embodiment, is not integrally-formed with gear 27.

Tape 17, which contains a backing and a web of adhesive (not visible separately in the drawings) is threaded from supply reel 5, around tape roller 9, and onto take-up reel 7. When the dispenser is applied to working surface 45 and moved in the direction indicated by arrow 47, the supply reel, tape roller, take-up reel, and tape will move in the directions indicated by arrows 11, 13, 15, and 19.

Take-up reel 7 is shown as having lugs 16. While the figure shows the tape being wound directly on the reel, it is often preferable, in practice, to wind the tape on a rigid core (not shown in the figures), and to insert the core onto the reel. In the latter case, the interior of the core would be provided with a plurality of lugs, which would engage adjacent lugs disposed on the reel. This arrangement prevents the core and the reel from rotating relative to each other. The lugs shown in FIG. 1 are rectangular in shape, but it is understood that they could assume many other forms. For example, the lugs can be replaced with triangular or pyrimidal projections, or equivalent structures. Also, it is understood that similar lugs or projections can be provided on the supply reel as well, though this possibility is not shown in FIG. 1, for clarity of illustration. The lugs or projections are not considered part of this invention.

The transfer adhesive used on the tape is a conventional composition, and is of the type which will readily separate from the backing as the tape is moved along the working surface. The adhesive can be the same material used in the manufacture of self-adhering note pads, such as the products sold under the trademark "Post-It", by the Minnesota Mining and Manufacturing Co. However, other compositions which meet the above-described requirements can be used, and this invention should not be deemed limited by the particular choice of adhesive material.

Tape roller 9 is attached to lever 21 which moves around pivot 23. Pivot 23 acts as a fulcrum for lever 21. The end of the lever 21, opposite the tape roller, has a serrated edge 57 which mates with and engages teeth 43 on toothed wheel 55 attached to the gear 25. The serrated edge can be replaced with a detent of similar construction.

In the embodiment of FIG. 1, lever 21 is integrally-formed with a flexible spring bar 29, which rests against stop 31. The spring bar is generally parallel to the lever. The spring bar maintains the lever in the engaged position, i.e. the position wherein the end of the lever engages teeth 43 of toothed wheel 55. Thus, in the normal position, supply reel 5, and therefore tape roller 9 and take-up reel 7, cannot rotate.

When the dispenser 1 is pressed against working surface 45, lever 21 pivots in the direction indicated by arrow 53, thereby releasing teeth 43 from toothed wheel 55, and allowing the reels, tape, and tape roller to rotate.

Figure 2:
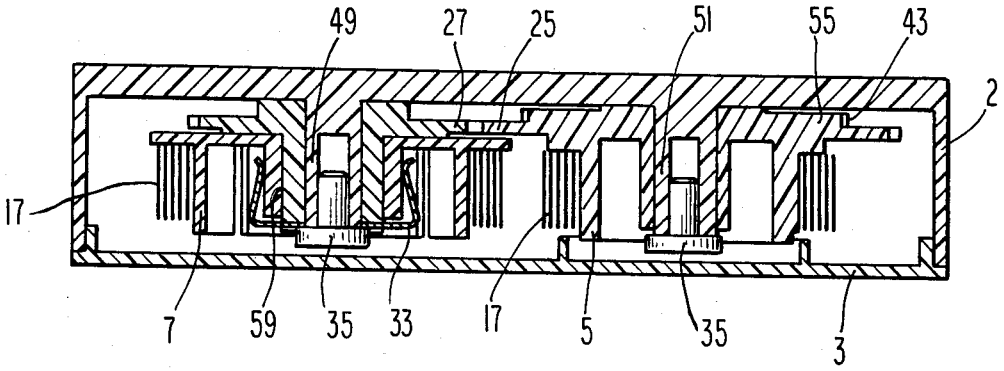
FIG. 2 is a cross-sectional view of the dispenser, taken along the line 2—2 of FIG. 1.

FIG. 2 shows more details of the interior construction of the dispenser. Take-up reel 7 is held against its bearing surface 49 by clutch spring 33, which is anchored by assembly button 35. Bearing surface 49 is integrally-formed with housing 2. Gear 27 is integral with its own bearing surface 59, around which take-up reel 7 rotates. Thus, take-up reel 7 rotates around bearing surface 59, which rotates around bearing surface 49. While the bearing surfaces are shown as integrally-formed with other components, it is understood that these surfaces could be formed as separate parts, and attached to the housing or the gear.

FIG. 2 also shows the construction of supply reel 5. Supply reel 5 rotates around bearing surface 51, which is shown as integral with housing 2. Gear 25 is shown as integral with supply reel 5. Toothed wheel 55 is also visible, and is integrally-formed with gear 25. Again, the components that are integrally-formed could be fashioned separately, if desired.

Figure 3:
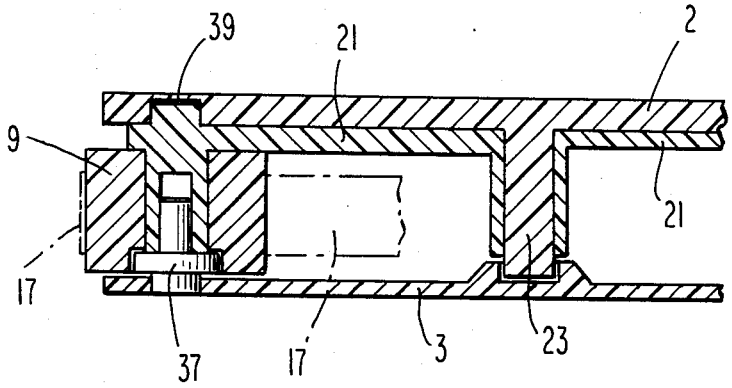
FIG. 3 is a cross-sectional view of the tape roller and lever, and is taken along the line 3—3 of FIG. 1.
Figure 4:
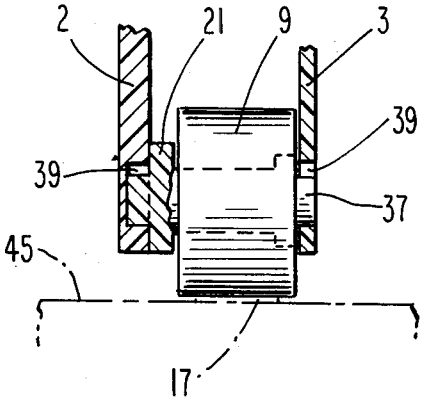
FIG. 4 is a cross-sectional view of the tape roller, taken along the line 4—4 of FIG. 1.

The details of tape roller 9 and lever 21 are shown more clearly in FIG. 3. Tape roller 9 is held in place by roller support button 37 which fits through a slot in lid 3. FIG. 3 shows pivot 23 as being integral with housing 2. Slot 39 allows the tape roller to move when the lever rotates about pivot 23. Slot 39 is more clearly visible in the view of FIG. 4, which shows tape roller 9, roller support button 37, housing 2 and lid 3. Slot 39 thus allows the tape roller to move upwardly, as shown in FIG. 4, when the lever disengages the toothed wheel of the supply reel.

Figure 5:
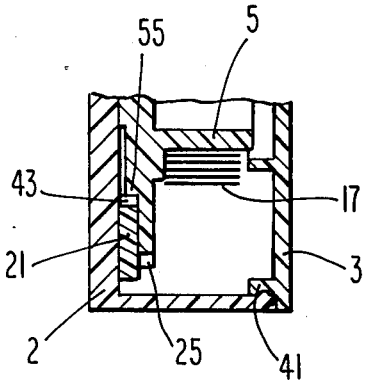
FIG. 5 is a cross sectional view, showing the engagement of the detent with the supply reel, taken along the line 5—5 of FIG. 1.

FIG. 5 shows the details of the engagement of the lever and the toothed wheel. Lever 21 is shown engaging teeth 43. Gear 25 is shown adjacent, and integrally-formed with, toothed wheel 55.

FIG. 5 also illustrates the means of attachment of housing 2 and lid 3. Lid 3 includes snap means 41 which mates with a complementary surface on the housing, to allow the lid to snap onto the housing without screws. The lid can therefore be easily removed and replaced, whenever it is necessary to gain access to the interior of the device.

The operation of the dispenser can now be described. When the device is not in use, the pressure of spring bar 29 causes lever 21 to remain engaged with toothed wheel 55 of supply reel 5. The supply reel therefore cannot rotate, and take-up reel 7 also does not rotate because it is geared to the supply reel. Thus, no tape can be fed from the supply reel while the device is not in use.

When the device is to be used, it is placed on a working surface, and is pressed against that surface. This pressure causes the lever to pivot, releasing teeth 43 from toothed wheel 55. Thus, the supply reel, take-up reel, and tape roller become free to rotate. As the dispenser is moved laterally, along the working surface (as indicated by arrow 47 in FIG. 1), the tape is drawn from the supply reel, around the tape roller, and onto the take-up reel.

The motive force for the reels and roller is thus derived from the friction between the tape and the working surface. This friction pulls on the tape, which in turn causes the supply reel and tape roller to rotate. Rotation of the supply reel causes rotation of the take-up reel, through their geared engagement. As successive regions of the tape touch the working surface, the transfer adhesive is transferred from the tape to the surface, and the remaining backing is what is wound onto the take-up roller.

The diameter of gear 25 is larger than that of gear 27, and is chosen such that gear 27 rotates 1.5 times faster than does gear 25. This gear ratio assures that there will be no slack in the tape. The value of the gear ratio is not critical; what is important is that the take-up reel rotate faster than the supply reel, so that there will never be any slack in the tape.

The structure shown also accommodates the different rates at which the reels will feed the tape and take up the spent backing. If gear 27 is rotated more rapidly than is necessary for take-up 7 to take up the spent backing, no harm is done, because the take-up reel can still rotate around bearing surface 59. The take-up reel is not rigidly connected to gear 27. Thus, the tape remains taut, but is not stretched to the point of rupture. The structure described above therefore compensates fully for the constantly changing rates of rotation of the two reels.

The structure described above has the additional advantage that the spent backing can be easily removed from the dispenser. The spent backing is wound around take-up reel 7, and there are no clamps, or other equivalent structures, to hold it onto the reel. To reach the spent backing, only the lid 3 of housing 2 need be removed. The backing can then be simply lifted out of the device, without disturbing any of the other components.

Figure 6:
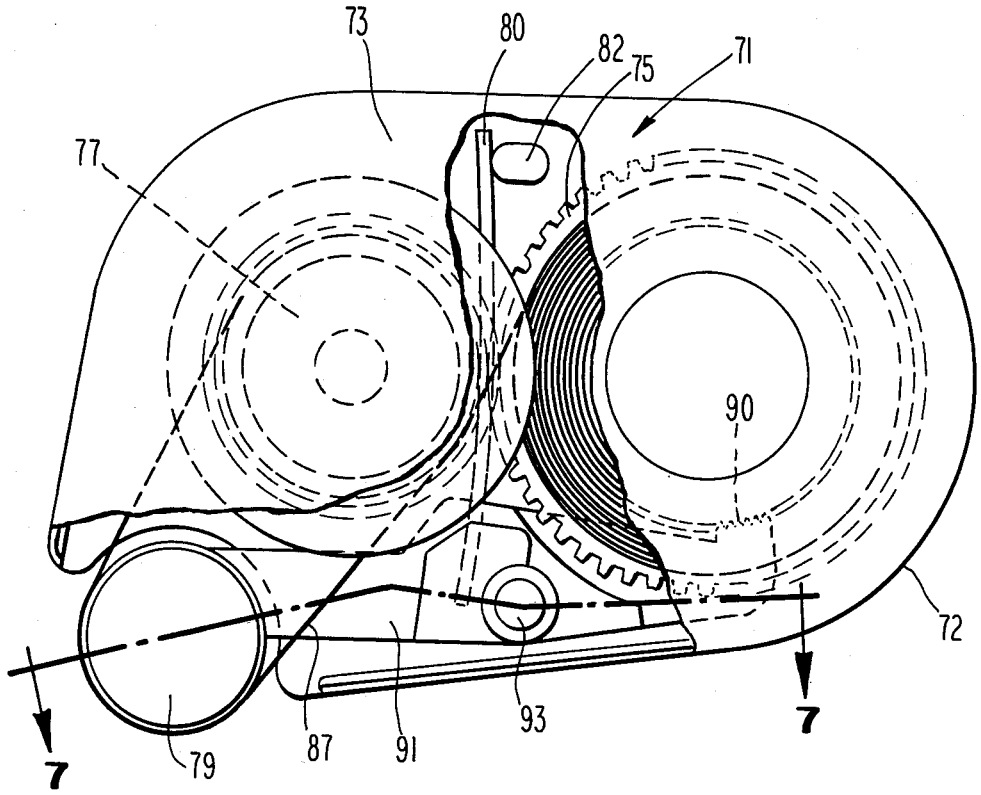
FIG. 6 is a top plan view, partly broken away, showing the tape dispenser made according to another embodiment of the invention.
Figure 7:
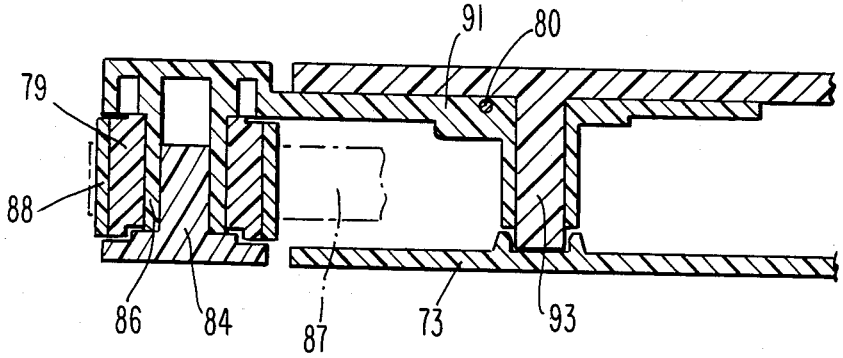
FIG. 7 is a cross-sectional view, taken along the line 7—7 of FIG. 6.

FIGS. 6 and 7 show another embodiment of the invention. The dispenser shown in these figures is used in exactly the same manner as described above with respect to FIG. 1. The second embodiment differs in certain structural features, relating to the spring bar and the mounting of the tape roller.

FIG. 6 is a plan view, generally similar to that of FIG. 1. For clarity of illustration, FIG. 6 does not repeat all the details of FIG. 1. For example, the lugs on the reels (i.e. elements 16 in FIG. 1) are not shown. Other features, such as the mounting of the reels, common to both embodiments, are also not illustrated in detail..

FIG. 6 shows dispenser 71 having housing 72 and lid 73. Also visible are supply reel 75 and take-up reel 77. Tape 87 passes from the supply reel, around tape roller 79, and then to the take-up reel. Lever 91, mounted on pivot 93, like lever 21 of FIG. 1, prevents the supply reel from moving when the dispenser is not in use, by engagement of teeth 90. Indeed, the operation of the embodiment of FIG. 6 is substantially identical to that of the embodiment of FIG. 1.

Unlike the embodiment of FIG. 1, lever 91 does not have a spring means integrally formed with the lever. Instead, there is a rod 80 which is inserted into a hole in the lever. The rod abuts stop 82. The stop can be integrally formed with the housing, or it can be formed separately and then attached to the housing. The rod is generally perpendicular to the lever. The rod is not secured to the lever, however, and can freely slide within the hole. The walls of the dispenser housing prevent the rod from sliding out of position.

Rod 80 is preferably made of metal. It should not be so rigid that it cannot bend; indeed, FIG. 6 shows the rod in a slightly bent condition. On the other hand, the rod should have sufficient stiffness that it always tends to return to the unbent condition. In this way, the rod acts as a spring, and holds the lever in engagement with the teeth of the supply reel when the dispenser is not in use. The hold should be sufficiently deep to allow the rod to become anchored in the lever, and thereby to act as a spring.

FIG. 7 shows the connection of the tape roller to the dispener. Tape roller 79 is attached to the dispenser solely by lever 91. Lever 91 is integral with bearing surface 86, on which the tape roller rotates. The tape roller can be provided with a rubber surface 88. The tape roller is fastened in place by roller support button 84. FIG. 7 also shows the location of rod 80, inserted into the hole in lever 91.

When the dispenser of FIGS. 6 and 7 is pressed against a working surface, the upward movement of the tape roller is stopped by the housing itself. This is different from the embodiment of FIG. 1, wherein the tape roller is stopped by a portion of the lever which is caught within a slot (shown in FIG. 4). In the embodiment of FIG. 7, when the dispenser is pressed against a surface, the structures on either side of the tape roller, namely the roller support button and a portion of the lever itself, contact the housing, and prevent the tape roller from further upward movement. The tape roller itself does not touch the housing, but instead moves upward into a cavity defined by the housing. Thus, the tape roller is free to rotate while the device is pressed against the surface.

The arrangement of FIGS. 6 and 7 is easier to manufacture than the embodiment of FIG. 1. It is much easier to mold a hole, in the plastic lever, to accommodate a rod which is generally perpendicular to the lever, than to form a hole which receives a rod at an oblique angle. It is also easier to insert an ordinary metal rod into a hole than to form a plastic rod integrally with the lever.

Moreover, the arrangement of FIG. 6 allows the rod to be made longer than the spring bar 29 of FIG. 1.

It is understood, however, that the spring bar or rod can be mounted to the lever in many other ways. This invention should not be deemed limited by the particular manner by which the spring means is connected to the lever. It also should not be limited by the angle which the rod makes with the lever.

While the invention has been described with respect to two specific embodiments, it is understood that the invention can be modified in many other ways. As stated above, the driving gears do not need to be integrally-formed with the housing, but could also be provided as separate components. Also, the toothed wheel need not be integral with the gear of the supply reel, but could be a distinct part. The particular form of the teeth or detent on the lever, and the form of the spring means for the lever could also be changed. The structure shown above contemplates that the spring bar takes the form of a rod, but other configurations, such as conventional springs, could also be used. These and other similar modifications are to be considered within the spirit and scope of the following claims.

What is claimed is:

1. A dispenser for applying a transfer adhesive material to a surface, comprising:

(a) a supply reel, (b) a take-up reel, the supply reel and take-up reel being geared such that rotational motion of the take-up reel is transmitted to the supply reel, the supply reel also having a toothed wheel, and (c) a tape of transfer adhesive material, the tape including a backing and a transfer adhesive attached thereto, the tape being wound around the supply reel, around a tape roller, and onto the take-up reel, (d) the tape roller being attached to one end of a lever, the lever being mounted to pivot about its fulcrum, the other end of the lever having a first position wherein the lever engages the supply reel so as to prevent rotational movement of the supply reel, and a second position wherein the lever is disengaged from the supply reel so as to allow the supply reel to rotate, the lever being pivotable from the first position to the second position by pressure applied to the dispenser towards the surface, the lever being spring-biased to assume the first position when the dispenser is not in use.

2. The dispenser of claim 1, wherein the lever is connected to a spring bar, the spring bar contacting a stop means, wherein pressure of the spring bar against the stop means biases the lever to assume said first position.

3. The dispenser of claim 2, wherein the spring bar is integrally-formed with the lever.

4. The dispenser of claim 2, wherein the engagement of the lever and the supply reel is achieved between a tooth means disposed at the end of the lever, and a toothed wheel attached to the supply reel.

5. The dispenser of claim 4, wherein the supply reel and take-up reel include gears for engaging the reels, and wherein the supply reel is integral with its gear, and wherein the take-up reel is distinct from its gear.

6. The dispenser of claim 1, wherein the supply reel and the take-up reel are both moved by gears, wherein the take-up reel rotates about 1.5 times faster than the supply reel.

7. The dispenser of claim 6, wherein the take-up reel is mounted for rotation around a bearing surface, and wherein the take-up reel is distinct from its gear, whereby the take-up reel can rotate at speeds less than that of its gear.

8. The dispenser of claim 2, wherein the spring bar comprises a rod inserted into a hole in the lever.

9. The dispenser of claim 8, wherein the rod is generally perpendicular to the lever.

10. In a dispenser for transferring an adhesive material to a surface, the dispenser having a supply reel and a take-up reel, and a strip of material wound onto the supply and take-up reels, the strip of material wound onto the supply and take-up reels, the strip of material including a backing and a transfer adhesive, the strip being disposed around a tape roller, the tape roller being adapted to apply the adhesive to a surface, the improvement wherein the tape roller is connected to a spring-biased lever, the lever being capable of assuming a first position wherein the lever comprises means for preventing rotation of the supply reel, and a second position wherein the lever permits rotation of the supply reel, the lever being normally in the first position, and wherein the lever is movable to its second position by pressure applied to the dispenser towards the surface.

11. The improvement of claim 10, wherein the lever is connected to a semi-rigid member which abuts at least one of said reels, wherein said semi-rigid member comprises means for spring-biasing the lever.

12. The improvement of claim 10, wherein there is a rod inserted into a hole in the lever, the rod being held against a stop means, the rod comprising means for spring-biasing the lever.

13. The improvement of claim 10, wherein the supply reel includes a first gear, and wherein the take-up reel is connected to a second gear, the take-up reel being distinct from the second gear, wherein the first and second gears are engaged such that rotation of one reel tends to cause rotation of the other reel, and wherein the take-up reel can rotate around a bearing surface connected to the second gear.

14. The improvement of claim 13, wherein the take-up reel is held around the bearing surface by a spring means.

15. The improvement of claim 14, wherein the bearing surface is integrally-formed with the second gear.

16. The improvement of claim 10, wherein the supply reel includes a toothed wheel means, and wherein the lever includes means for engaging said toothed wheel means when the lever is in said first position.

17. The improvement of claim 16, wherein the toothed wheel means is integrally-formed with the supply reel.

18. A dispenser for transferring adhesive material to a surface, comprising a supply reel and a take-up reel, the supply reel and take-up reel being connected to gears such that rotation of the take-up reel is transmitted to the supply reel, and a tape roller, the tape roller being positioned such that a tape of transfer adhesive can be threaded from the supply reel, around the tape roller, and onto the take-up reel, the tape roller being attached near one end of a lever, the other end of the lever being capable of assuming a first position wherein the lever engages the supply reel so as to prevent rotation of the supply reel, and a second position wherein the lever is disengaged from the supply reel, the lever being movable from the first position to the second position by pressure applied to the dispenser towards the surface.

19. The dispenser of claim 18, wherein the lever is biased by a spring means, such that the lever is in the first position when the dispenser is not in use.

20. The dispenser of claim 19, wherein the spring means comprises a spring bar, integrally formed with the lever.

21. The dispenser of claim 19, wherein the spring means comprises a rod inserted into a hole in the lever.

22. The dispenser of claim 19, wherein the diameters of the gears are chosen such that the take-up reel tends to rotate faster than the supply reel.

23. The dispenser of claim 22, wherein the take-up reel is distinct from its gear, and wherein the take-up reel is mounted for rotation around a bearing surface at a rotational speed which is different from that of its gear.

24. The dispenser of claim 23, wherein the supply reel is connected to a toothed wheel means, and wherein the lever includes means for engaging the toothed wheel means.

25. The dispenser of claim 24, wherein the supply reel is integrally-formed with the toothed wheel means.

* * * * *